US008962076B2

(12) United States Patent
Wagner

(10) Patent No.: US 8,962,076 B2
(45) Date of Patent: Feb. 24, 2015

(54) METHOD OF MANUFACTURING A HOLLOW BODY PROVIDED WITH A METAL-PLATED GLASS INSIDE SURFACE

(75) Inventor: Christophe Jean Wagner, Neuville les Dieppe (FR)

(73) Assignee: SGD S.A., Puteaux (FR)

( * ) Notice: Subject to any disclaimer, the term of this patent is extended or adjusted under 35 U.S.C. 154(b) by 145 days.

(21) Appl. No.: 13/131,533

(22) PCT Filed: Nov. 27, 2009

(86) PCT No.: PCT/FR2009/052327

§ 371 (c)(1),
(2), (4) Date: May 26, 2011

(87) PCT Pub. No.: WO2010/061150

PCT Pub. Date: Jun. 3, 2010

(65) Prior Publication Data

US 2011/0220535 A1 Sep. 15, 2011

(30) Foreign Application Priority Data

Nov. 27, 2008 (FR) ..... 08 06660

(51) Int. Cl.

| | |
|---|---|
| ***B05D 7/22*** | (2006.01) |
| ***C23C 18/44*** | (2006.01) |
| ***C23C 18/18*** | (2006.01) |
| ***C23C 18/31*** | (2006.01) |
| *B65D 23/02* | (2006.01) |

(52) U.S. Cl.

CPC ..... *B05D 7/227* (2013.01); *C23C 18/1851* (2013.01); *C23C 18/31* (2013.01); *C23C 18/44* (2013.01); *B05D 2203/35* (2013.01); *B05D 2425/01* (2013.01); *B65D 23/02* (2013.01)

USPC ..... 427/230; 427/236; 427/437; 427/443.1; 206/524.6

(58) Field of Classification Search

CPC ..... B05D 7/227

USPC ..... 427/230–239, 437, 443.1; 206/524.6

See application file for complete search history.

(56) References Cited

U.S. PATENT DOCUMENTS

| | | | | |
|---|---|---|---|---|
| 4,043,318 | A * | 8/1977 | Pei | 126/643 |
| 6,224,983 | B1 * | 5/2001 | Sodervall et al. | 428/461 |
| 6,238,749 | B1 * | 5/2001 | Willard et al. | 427/510 |
| 6,599,573 | B2 * | 7/2003 | Gajdosik et al. | 427/255.11 |
| 6,902,761 | B2 * | 6/2005 | Tratzky et al. | 427/235 |

FOREIGN PATENT DOCUMENTS

CA 2 406 980 A1 * 10/2003

* cited by examiner

*Primary Examiner* — William P Fletcher, III

(74) *Attorney, Agent, or Firm* — McClure, Qualey & Rodack, LLP

(57) ABSTRACT

A method of manufacturing a hollow body is disclosed, the body provided with a glass inside surface defining a cavity, said method being characterized in that it includes a step of covering at least a fraction of said inside surface with a lining of composition that is mostly metal, said covering step including sub-steps of activating and of grafting said inside surface respectively with an activation agent and with a grafting agent, and in that said hollow body comprises a single piece of glass inside which said cavity is formed.

15 Claims, 1 Drawing Sheet

METHOD OF MANUFACTURING A HOLLOW BODY PROVIDED WITH A METAL-PLATED GLASS INSIDE SURFACE

TECHNICAL FIELD

The present invention relates to the general technical field of hollow bodies provided with glass inside surfaces that are usable in various industries, such as, for example, in the packaging industry (glass containers of the bottle type or of the jar type that serve to contain liquid or semi-liquid substances, such as, for example a cosmetic substance or a pharmaceutical substance), or in the construction industry (hollow glass blocks). The invention also relates to the general technical field of treatment of glass surfaces for functional and/or decorative purposes.

The invention relates more precisely to a method of manufacturing a hollow body provided with a glass inside surface defining a cavity, and to such a hollow body.

PRIOR ART

It is known that glass containers can be used to contain liquid substances, in particular in the cosmetics, pharmaceuticals, and food industries. In particular, the use of glass for making containers for liquid perfume is particularly valued, in view of the excellent image that consumers generally have of glass, and of its objective qualities of transparency, of robustness, and of mechanical and chemical stability. That is why, all or almost all liquid body perfumes, and in particular perfumes considered to be "top-of-the-range", are contained in glass bottles.

The esthetic qualities of the perfume bottle are also extremely important to the overall commercial attractiveness of a perfume. To this end, it is thus essential to propose a perfume bottle having an esthetic appearance that is very clearly different from the appearances of competitor bottles, and that is particularly attractive and enhancing for the perfume contained in the bottle.

That task is, however, made difficult for two main reasons.

The first reason lies in the fact that glass is, by its very nature, a material that is singularly difficult to work and to decorate under economically acceptable conditions, which is essential in the "consumer" economic sectors such as the perfume sector.

The second reason relates to the environment to which perfume bottle glass is subjected, and to the general context in which such bottles are used. In particular, the inside of a perfume bottle is in direct contact with the perfume itself, which usually consists of an alcoholic liquid. That means that any decoration disposed on the inside of the bottle, so as to be visible by transparency to the consumer from the outside, must be capable of withstanding continuous and long-term immersion in such an alcoholic solution without coming off, disintegrating, decomposing, or dissolving, which constitutes a genuine technical challenge. In addition to the catastrophic effects in terms of brand image that could be caused by a decoration inside the bottle deteriorating due to its prolonged immersion in the liquid perfume, such deterioration might also give rise to health problems, insofar as the composition of the perfume would be modified and would contain a more or less dispersed phase of the material that originally constituted the decoration on the inside surface of the bottle. Thus, while it is extremely advantageous, at least for reasons of esthetic appearance, to decorate the inside surface of a glass bottle so that it is visible by transparency from the outside, such internal decoration is extremely difficult to achieve in practice, in view of the aggressiveness of the ambient alcoholic environment and of the difficulty of ensuring that a coating or a lining stays on a glass substrate.

SUMMARY OF THE INVENTION

Objects assigned to the invention are therefore to remedy the problems described above, and to propose a novel method of manufacturing a hollow body provided with a glass inside surface that makes it possible to obtain a hollow body that is particularly esthetically attractive.

Another object of the invention is to propose a novel method of manufacturing a hollow body provided with a glass inside surface that makes it possible to obtain a hollow body that is particularly esthetically attractive and that is resistant to wear, both mechanically and chemically.

Another object of the invention is to propose a novel method of manufacturing a hollow body provided with a glass inside surface that makes it possible to obtain a hollow body that is particularly esthetically attractive in extremely quick and inexpensive manner.

Another object of the invention is to propose a novel method of manufacturing a hollow body provided with a glass inside surface that is not only quick but that also makes it possible to provide said hollow body with a decoration that is particularly homogeneous and exempt from defects.

Another object of the invention is to propose a novel method of manufacturing a hollow body provided with a glass inside surface that makes it possible to obtain a hollow body that is not only very esthetically attractive but that is also extremely robust and durable.

Another object of the invention is to propose a novel method of manufacturing a hollow body provided with a glass inside surface that makes it possible to obtain a hollow body that is capable of stably and durably containing a fluid substance, and in particular a fluid substance that is relatively aggressive chemically.

Another object of the invention is to propose a novel hollow body provided with a glass inside surface that is particularly esthetically attractive.

Another object of the invention is to propose a novel hollow body provided with a glass inside surface decorated in particularly elegant and choice manner that is also suitable for contributing to preserving any substance, and in particular any medicinal substance, that might be contained in said hollow body.

Another object of the invention is to propose a novel hollow body provided with a glass inside surface decorated particularly richly and attractively.

Another object of the invention is to propose a novel hollow body provided with a glass inside surface that is suitable for reliably and durably containing a fluid substance, and in particular a fluid substance that is relatively aggressive chemically.

The objects assigned to the invention are achieved by means of a method of manufacturing a hollow body provided with a glass inside surface defining a cavity, said method being characterized in that it includes a step of covering at least a fraction of said inside surface with a lining of composition that is mostly metal, said covering step including substeps of activating and of grafting said inside surface respectively with an activation agent and with a grafting agent, and in that said hollow body comprises a single piece of glass inside which said cavity is formed.

The objects assigned to the invention are also achieved by means of a hollow body provided with a glass inside surface defining a cavity, said hollow body being characterized in that at least a fraction of said inside surface is covered with a lining of composition that is mostly metal, said covering with the lining being obtained by using a method including at least:

a sub-step of activating said inside surface by putting the inside surface into contact with an activation agent, so that the activation agent is present at the surface of said inside surface; and a sub-step of grafting with a grafting agent that bonds chemically to the activation agent;

and in that it comprises a single piece of glass inside which said cavity is formed.

BRIEF DESCRIPTION OF THE DRAWING

Other objects and advantages of the invention appear more clearly on reading the following description and on examining the accompanying drawing, which is given merely by way of non-limiting illustration, and in which.

BEST MANNER OF IMPLEMENTING THE INVENTION

The invention relates firstly to a method of manufacturing a hollow body 1 provided with a glass inside surface 2 defining a cavity 3.

Figure 1:
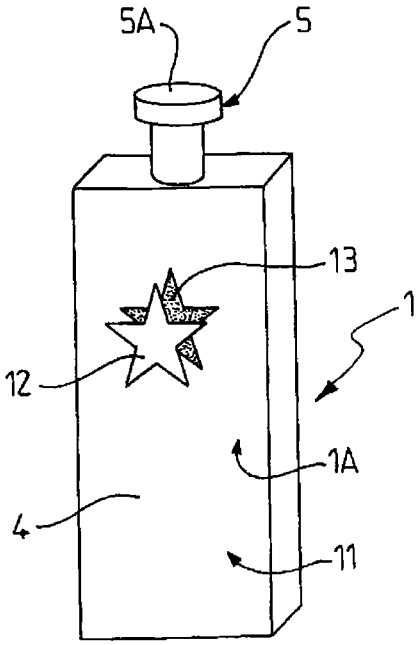
FIG. 1 is a diagrammatic perspective view of a hollow body of the invention that, in this example, is constituted by a bottle designed to contain a liquid body perfume, said bottle being closed with a stopper.
Figure 2:
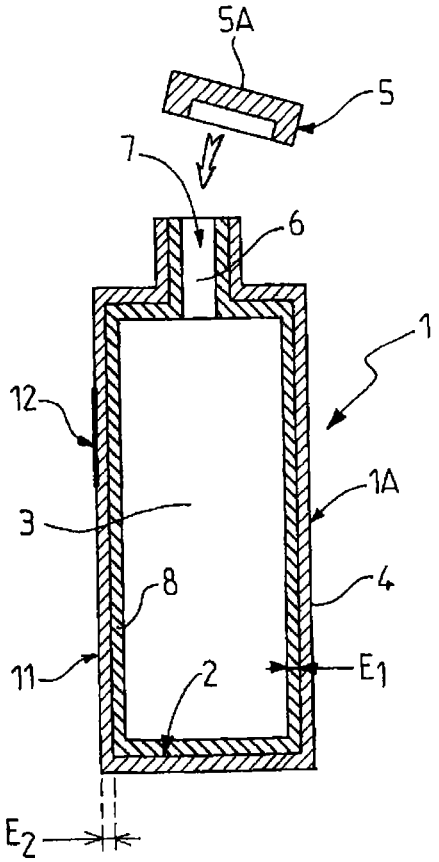
FIG. 2 is a diagrammatic section view of the FIG. 1 bottle as open.

As shown in FIGS. 1 and 2, the hollow body 1 preferably constitutes a container 4 designed for containing a liquid or semi-liquid substance, and in particular an alcoholic substance such as a body perfume, in the cavity 3. In which case, the container 4 is advantageously designed to be closed by means of a closure member 5, constituted, for example, by a stopper 5A.

In a preferred implementation that corresponds to the implementation shown in the figures, the method of the invention thus consists of a method of manufacturing a bottle designed to contain a liquid or semi-liquid cosmetics substance, and preferably a scented alcoholic liquid. However, it is quite possible for the method of the invention to constitute a method of manufacturing a bottle designed to contain a substance other than a cosmetic, and, for example, to contain a pharmaceutical substance, such as a medicinal substance.

Naturally, applications other than cosmetic or pharmaceutical applications are possible. For example, the hollow body 1 may constitute a hollow glass block, usable for construction and/or for decoration, the method of the invention then consisting of a method of manufacturing a hollow glass block.

For reasons of simplicity of description, only manufacturing a perfume bottle is described in detail below, merely by way of non-limiting illustration.

Naturally, the method of the invention firstly includes a step of manufacturing or of supplying a hollow body 1 provided with a glass inside surface 2 defining a cavity 3. The term "glass" should be understood herein in its conventionally accepted meaning, and it thus designates a mineral glass. Preferably, this step of manufacturing or of supplying the hollow body 1 with its glass inside surface 2 consists in manufacturing or supplying a one-piece hollow body made entirely of glass, and inside which the cavity 3 is formed. In other words, the hollow body 1 is constituted by a single part manufactured as an integrally formed single piece, e.g. by using a glass-blowing or molding method. Making such a hollow body of glass, in particular when said hollow body constitutes a bottle, is very well known per se and can be achieved by any conventional glass-making method. Naturally, the fact that the hollow body 1 defining the cavity 3 is made in one piece, and not by assembling together independent pieces, makes it all the more difficult to decorate the inside of the hollow body 1, in particular when said hollow body is provided with a neck (as a bottle is, for example), such a neck further restricting access to the cavity 3.

As explained above, the hollow body 1 is provided with a cavity 3 defined by an inside surface 2, i.e. the hollow body 1 defines an empty volume inside it. Preferably, the hollow body 1 is shaped so that the cavity 3 forms a narrower section or throat 6 defining an opening 7 making it possible to put the cavity 3 into communication with the outside, said opening 7 preferably being designed to co-operate with said closure member 5 to close the hollow body 1 when said hollow body constitutes a container 4. In which case, the cavity 3 forms an empty internal volume that is fully closed except for an opening 7 to the outside, the section of which opening is smaller than the average section of the cavity 3, as shown in FIG. 2. Such a configuration is characteristic of a bottle provided with a neck, i.e. with a narrow throat making it possible to put the inside of the bottle into communication with the outside.

In accordance with the invention, the method also includes a step of covering at least a fraction of the inside surface 2 with a coating or lining 8 of composition that is mostly metal. In order to obtain specific esthetic effects, it is also possible for the composition of the lining 8 to include a (minority) fraction of a dye, e.g. in the form of a colored pigment dispersed homogeneously in the lining 8, mixed with the metal making up most of said lining.

Preferably, the covering step is designed so that substantially all of the inside surface 2 is covered with the lining 8 of composition that is mostly metal, as shown in FIG. 2. However, it is quite possible, without going beyond the ambit of the invention, for only a fraction of the inside surface 2, i.e. the surface situated facing the empty volume forming the cavity 3, to be covered with the lining 8 in question.

Preferably, the composition of the lining 8 is substantially totally metal, and the lining is preferably made of a shiny metal suitable for procuring a reflective ("mirror") effect, such as silver, and to a lesser extent gold, nickel, platinum, zinc, and copper. In particular, it is quite possible for most or indeed all of the composition of the lining 8 to be constituted by gold. Such a gold lining, seen from the outside through the transparent wall of the hollow body 1, procures an esthetic result that is quite remarkable, gold also being tolerated by the human system so that it can be put into direct contact with the substance that is contained in the cavity 3 (e.g. perfume).

Alternatively, it is also possible for the lining 8 to be advantageously composed of a precious (noble) metal, such as palladium, rhodium, ruthenium, or osmium, for example, or of some other, non-precious metal such as tin or cobalt. By covering the inside surface 2 with such a lining of composition that is mostly metal, it is possible to decorate the hollow body 1 in particularly original manner, insofar as the metal lining 8 is advantageously visible by transparency through the wall 1A of the hollow body 1 forming the inside surface 2. The inside surface 2 may be made of transparent colorless glass, it being understood that a glass that is colored and/or translucent can also give good esthetic results. The characteristics of the glass that is used, and in particular its type and its thickness, can advantageously influence the original esthetic effects imparted by the lining 8.

In addition, the fact that the composition of the lining 8 is mostly metal can impart specific functional properties to the hollow body 1 that is provided with the lining on its inside surface 2. For example, a lining 8 essentially made of silver makes it possible to confer microbicidal properties to the inside surface 2, which is particularly useful in the pharmaceutical sector.

Advantageously, the method of the invention includes a step of washing the glass inside surface 2 of the hollow body 1, preferably with demineralized water. Preferably, this washing step is performed using a rinsing liquid (preferably demineralized water) of pH substantially equal to or greater than 5, and even more preferably equal to or greater than 5.5. the choice of such a pH is particularly beneficial because it makes it possible, in particular when a lining 8 based on silver is implemented as covering, substantially to avoid a phenomenon of degradation of the silver layer deposited on the inside surface 2.

Then, the above-mentioned covering step is implemented.

Advantageously, this covering step firstly includes a sub-step of activating the inside surface 2, in order thus to obtain an inside surface 2 that is activated, i.e. that is more chemically reactive than the bare inside surface 2. Preferably, this activation sub-step makes it possible to increase the surface energy of the glass inside surface 2 so as to enhance the chemical reactivity thereof. Preferably, the activation sub-step is performed by putting the inside surface 2 into contact with a tin chloride ($SnCl_2$) solution as an activator agent (also known as an "activation agent"), tin chloride being particularly suitable for implementing a method aimed at coating the inside surface 2 with a silver lining. Advantageously, putting the inside surface 2 into contact with the tin chloride solution forming an activation solution consists in filling the cavity 3 with the tin chloride solution for a length of time sufficient to enable the inside surface 2 to be activated and to obtain an activated inside surface 2. Preferably, the activation sub-step is performed by the activation solution coming into direct contact with the inside surface 2, i.e. in the absence of any intermediate layer (e.g. a primer layer) covering the glass inside surface 2.

Thereafter, once the inside surface 2 is activated, the tin chloride solution is removed from the cavity 3. Alternatively, putting the inside surface 2 into contact with the activation solution (tin chloride, in this example) consists in spraying the tin chloride solution onto the inside surface 2, i.e. in atomizing said tin chloride solution onto the inside surface 2 in the form of fine droplets (a spray). Such spraying may, for example, be performed using a spray nozzle inserted into the hollow body 1 (e.g. via the opening 7 if said hollow body forms a bottle provided with the opening 7 in question, and preferably via the throat 6 and therebeyond), a relative movement in rotation and in translation of the hollow body 1 and of the nozzle being implemented so that the tin chloride solution is atomized uniformly and homogeneously over the entire inside surface 2 to be treated, regardless of the shape of the cavity 3 defined by the inside surface 2. Putting the inside surface 2 into contact with the tin chloride solution by spraying said solution is particularly advantageous because it makes it possible to achieve fast industrialized treatment, with a quantity of tin chloride solution significantly smaller than the quantity required for implementing the above-described other method of putting said surface into contact with said solution.

Regardless of the method selected for putting the inside surface 2 into contact with the tin chloride solution, it is necessary for the inside surface 2 and the tin chloride solution to be kept in contact for a sufficient contact time (e.g. for about ten or fifteen seconds) before continuing with the method. Complying with this waiting time requirement makes it possible to limit the presence of esthetic defects in the lining 8 and to optimize the strength and mechanical and chemical stability of said lining 8 on the inside surface 2. The covering step then, after the above-mentioned waiting time, advantageously includes a sub-step of rinsing the activated inside surface 2, so as to remove any residue of the activation solution (which is preferably constituted by a tin chloride solution, as explained above).

In an implementation, the activated inside surface 2 has an activation layer (not shown) formed by the activation agent covering the inside surface 2 at least in part. In an alternative implementation, the activation step makes it possible to create activation spots (not shown) rather than an activation layer, which spots are constituted by the activation agent distributed discretely, and preferably uniformly, over the inside surface 2. Advantageously, the covering step subsequently includes a sub-step of grafting said activated inside surface 2 with a grafting agent, in order thus to obtain a grafted inside surface 2.

The grafting sub-step thus makes it possible to graft a grafting agent chemically onto the activated inside surface 2 by chemical reaction between the grafting agent and the activated inside surface 2, said reaction leading to chemical bonds being formed between the grafting agent and the activated inside surface 2. In other words, the grafting sub-step makes it possible to establish chemical bonds between the grafting agent and the activation agent. Alternatively, it is also possible for the grafting solution to come to key directly onto the inside surface 2. Advantageously, in particular for a method that serves to coat the inside surface 2 with a silver lining 8, the grafting agent is based on palladium. Advantageously, the grafting sub-step includes putting the activated inside surface 2 into contact with a grafting solution, which is preferably constituted by a palladium chloride solution ($PdCl_2$). In particularly advantageous manner, the activated inside surface 2 is put into contact with a grafting solution by filling the cavity 3 with said grafting solution, and preferably by filling said cavity 3 fully (to the brim).

Figure 3:
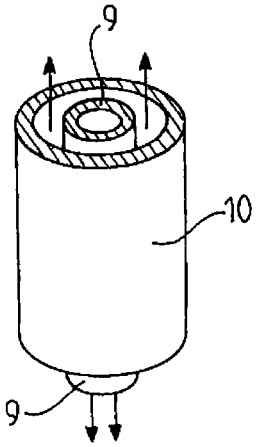
FIG. 3 is a fragmentary diagrammatic perspective view showing the operating principle of a machine suitable for contributing to implementing the method of the invention.

Preferably, the cavity 3 is filled with the grafting solution in automated manner. Thus, in a particularly advantageous implementation, the filling is performed by means of a filling machine having, as shown in FIG. 3, a central nozzle 9 via which the grafting solution (preferably constituted by a palladium chloride solution) flows towards and into the cavity 3, and a peripheral suction nozzle 10 that is concentric and coaxial with the central nozzle 9, and that serves to suck up any overflow of grafting solution. More precisely, the double nozzle is designed to come to fit the opening 7 giving access to the cavity 3, so that the peripheral suction nozzle 10 that is of diameter matching the diameter of the opening 7, prevents any overspill of the grafting solution from the container 4. To this end, the introduction of the grafting solution via the central nozzle 9, and the suction via the peripheral nozzle 10 are preferably performed simultaneously. In advantageous manner, the double nozzle is designed to enable the grafting solution to come into direct contact with the inside surface 2, regardless of the shape of the hollow body 1, in particular if it constitutes a bottle 4 with a throat 6.

Implementing such a filling machine, which also constitutes an invention per se, independently of the other aspects described herein, makes it possible to achieve a considerable gain in productivity because it makes it possible, by way of indication, to treat about 5 bottles (of capacity equal to 130 milliliters (ml)) per minute instead of 0.3 bottles per minute in a method implemented manually. Once the container 4 is filled, preferably completely, with the palladium chloride solution, said solution is left inside the container 4, in contact with the glass inside surface 2, for a contact time sufficient to establish chemical bonds between the activation agent present at the surface of the activated inside surface 2, and the grafting agent contained in the grafting solution.

In an implementation, the grafting agent is designed to form a grafting layer (not shown) that advantageously covers, at least in part, the activation agent (which is in the form of an activation layer or of a distribution of activation spots) that is keyed directly onto the inside surface 2. The inside surface 2 is thus covered, at least in part, with said activation layer and with said grafting layer, which layers are preferably superposed. The grafting step enables the grafting agent to form chemical bonds with the activation agent at the activation spots (or activation layer) present on the inside surface 2, in a manner such that chemical bonds are established between the activation agent and the grafting agent so as to form keying spots for the metal lining 8. For example, in the preferred implementation serving to form a silver lining 8, the palladium chloride solution is left for a contact time (e.g. about twenty or thirty seconds) that is sufficient to establish bonds between the palladium and the tin.

At the end of the contact period, the hollow body 1, constituted, in the example shown in the figures, by the container 4, is emptied, i.e. the grafting solution is removed from the cavity 3. Advantageously, the method of the invention includes a step of recovering the grafting solution after it has been put into contact with the activated inside surface 2, insofar as the recovered solution can be used again for grafting another inside surface of another hollow body. By way of indication, a quantity of about 2 ml of palladium is necessary for treating a bottle whose capacity, i.e. the volume of the cavity 3, is 130 ml.

Alternatively, putting the activated inside surface 2 into contact with the grafting solution (palladium chloride, in this example) may consist in spraying the palladium chloride solution onto the activated inside surface 2, i.e. in atomizing said palladium chloride solution onto the activated inside surface 2 in the form of fine droplets (a spray). Such spraying may, for example, be performed using a spray nozzle inserted into the hollow body 1 (e.g. via the opening 7 if said hollow body forms a bottle provided with the opening 7 in question, and preferably via the throat 6 and therebeyond), a relative movement in rotation and in translation of the hollow body 1 and of the nozzle being implemented so that the palladium chloride solution is atomized uniformly and homogeneously over the entire activated inside surface 2 to be treated. Putting the activated inside surface 2 into contact with the palladium chloride solution by spraying said solution is particularly advantageous because it makes it possible to achieve fast industrialized treatment, with a quantity of palladium chloride solution significantly smaller than the quantity required for implementing the above-described other method of putting said surface into contact with said solution.

Regardless of the method selected for putting the inside surface 2 into contact with the palladium chloride solution, it is necessary for the inside surface 2 and the palladium chloride solution to be kept in contact for a sufficient contact time (e.g. for about thirty seconds when the solution is sprayed on) before continuing with the method. Complying with this waiting time requirement makes it possible to limit the presence of esthetic defects in the lining 8 and to optimize the strength and mechanical and chemical stability of said lining 8 on the inside surface 2. After the grafting sub-step, the method of the invention advantageously includes a sub-step of rinsing the grafted inside surface 2, so as to remove any residue of the grafting solution. For example, when the grafting solution is constituted by a palladium chloride solution, the rinsing step makes it possible to remove any chloride residue, and thus to leave only the palladium on the inside surface 2.

In a preferred implementation, the activation sub-step is implemented before the grafting sub-step, as is described above, in such a manner as to obtain an inside surface 2 that is activated and then grafted. Alternatively, the grafting sub-step is advantageously performed before said activation sub-step or simultaneously therewith. Regardless of the chronological order of said activation and grafting sub-steps, they lead to anchor points being formed on the inside surface 2 for anchoring the metal lining 8, said anchor points being made up of activation and of grafting agents, which agents are advantageously bonded together.

The activation and grafting sub-steps are preferably performed using filling nozzles that offer the advantage of making it possible for the inside surface 2 of any type of hollow body 1 to be covered effectively and simply, regardless of the shape of said hollow body and even in the presence of a throat 6 forming a neck opening out at the opening 7. Advantageously, these two simultaneous or consecutive sub-steps make it possible to obtain an internal surface 2 having fastening points for fastening to the surface of the glass, which points facilitate and improve the keying of the metal onto the glass particularly effectively. Advantageously, the covering step implemented in the method of the invention includes a metal-plating sub-step making it possible to obtain a metal-plated inside surface, said metal-plating sub-step itself including:

- an operation of putting the grafted inside surface 2 into contact with a solution containing metal ions, and preferably silver ions; and
- an operation of introducing a reducing agent, preferably constituted by a gluconate, into said solution containing metal ions (preferably silver ions), while said solution is in contact with the grafted inside surface, so as to transform the metal ions into metal (preferably into silver) that keys onto the grafting agent (which is preferably palladium) present at the surface of the inside surface 2.

However, it is quite possible, alternatively, for said metal-plating sub-step to be conducted in inverse manner, i.e. for it to include:

- an operation of putting the grafted inside surface 2 into contact with a reducing agent solution, preferably constituted by a gluconate solution; and
- an operation of introducing metal ions, preferably silver ions, into said reducing agent solution, while said solution is in contact with the grafted inside surface, so as to transform the metal ions into metal (preferably into silver) that keys onto the grafting agent (which is preferably palladium) present at the surface of the inside surface 2.

Advantageously, the operation of putting the grafted inside surface 2 into contact with the solution containing metal ions, e.g. in the form of at least one metal salt, is performed by filling the cavity 3, optionally completely (to the brim), with said solution containing metal ions. The reducing agent, which is preferably a gluconate, is then introduced into the solution filling the cavity 3 so as to transform the metal ions (e.g. constituted by silver ions $Ag^+$) into metal (e.g. constituted by silver) that is keyed onto the grafting agent (e.g. constituted by palladium, which gives excellent results with a view to obtaining a silver lining 8).

By way of indication, when the solution serves to obtain a silver lining 8, the solution containing metal ions preferably contains about 2 ml of silver for a bottle to be treated having a capacity (volume of the cavity 3) of about 130 ml. Preferably, said solution containing silver ions includes at least silver nitrate ($AgNO_3$). Performing the metal-plating by subjecting the inside surface 2 to a liquid solution is particularly advantageous from an industrial point of view, because of its simplicity and of its competitive cost.

In particular, this metal-plating merely by filling the bottle with various different solutions (activation solution, grafting solution, and metal-plating solution) requires no complex and costly industrial means, and needs only basic and robust equipment that is easy to automate. Therefore, in its most advantageous implementations described above, the method of the invention offers excellent industrial effectiveness, with high productivity making it possible to achieve high production throughout rates and a relatively low cost, for an excellent result, in particular an excellent esthetic result. In particular, said activation and grafting solutions being sprayed by means of a nozzle 9 facilitates implementing the method of the invention, regardless of the shape of the hollow body 1, in particular if it includes a throat 6. The activation and the grafting, in particular with tin and with palladium, make it possible to achieve excellent keying of the metal onto the glass without degrading the appearance of said metal (no yellowing or loss of gloss). These activation and grafting agents are advantageously still present at the end of the method and they form a fastening interface between the glass inside surface 2 and the metal lining 6. Advantageously, prior to implementing the metal-plating sub-step, the covering step includes a sub-step of stoving the hollow body 1 (i.e. the container 4 in this example) for the purpose of raising the temperature of the inside surface 2.

For example, in the context of a method of covering the inside surface 2 with a silver layer (with a tin chloride solution as an activation solution and a palladium chloride solution as a grafting solution), this stoving sub-step is preferably conducted at a temperature substantially lying in the range 20° C. to 100° C., and preferably at a temperature of about 80° C., so that the hollow body 1 leaves the stove at a temperature preferably lying in the range 30° C. to 80° C., and, for example, substantially equal to 60° C. The metal-plating sub-step is then conducted on the hollow body 1 (i.e. on the bottle in the example shown in the figures) that is still warm, thereby making it possible to accelerate the reducing reaction that transforms the silver ions into metallic silver. Thus, by means of the stoving step that makes it possible to heat the bottle to about 60° C., for example, the reaction of transformation of the silver ions into metallic silver may last only about twenty seconds, whereas, at ambient temperature (about 20° C.) it would have lasted much longer (e.g. about 1 hour).

Advantageously, the metal-plating sub-step also includes a preferably mechanized agitation operation for agitating the grafted inside surface 2 while it is in contact with said solution containing both the metal ions and the reducing agent, so as to obtain a metal deposit that is substantially homogeneous over the grafted inside surface 2. In other words, the hollow body 1, i.e. advantageously the container 4, is joggled or shaken so that the metal resulting from the reducing reaction is distributed uniformly over the entire inside surface 2 in question. Thus, in the specific implementation for covering the inside surface 2 with silver, the agitation operation makes it possible to obtain a silver lining over the inside surface 2 that has a thickness $E_1$ that is particularly uniform over the entire treated surface. As indicated above, the agitation operation is preferably mechanized, or indeed automated, using conventional means making it possible to hold the bottle 4 and to shake it. Naturally, this does not in any way exclude the agitation operation being performed manually. However, implementing mechanized agitation makes it possible to achieve considerable productivity gains, because, combined with implementing automated filling with grafting solution (by means of a filling machine, as explained above), it makes it possible for about ten bottles (having capacity of 130 ml) to be treated per minute, while also reducing the quantities of solution containing metal ions and reducing agent. Thus, it is possible, using very simple operations for filling and joggling the container 4, to obtain a particularly uniform metal layer that is resistant and decorative on the inside surface 2 of said container 4, regardless of the shape thereof.

Advantageously, the metal-plating sub-step is conducted in such a manner that the inside surface 2 is covered with the lining 8 in a quantity per unit area that is substantially equal to or greater than 800 milligrams per square meter ($mg/m^2$), and preferably substantially equal to or greater than 1000 $mg/m^2$. In an advantageous implementation, the quantity per unit area is substantially equal to or greater than 1500 $mg/m^2$, and preferably substantially equal to or greater than 2000 $mg/m^2$.

The use of such a quantity per unit area for the lining 8 advantageously makes it possible to obtain a lining 8 that is reflective and opaque, without needing to use additional layers. Such reflective and opaque characteristics are particularly advantageous from an esthetic appearance point of view, and also make it possible to make an advantageous contribution to preserving the qualities of the liquid or semi-liquid substance contained in the hollow body 1, in particular when the substance is a perfume, by preventing the light from reaching it. Use of such a quantity per unit area also enables the lining to be held correctly on the inside surface 2, without any major risk of untimely detachment therefrom.

A quantity per unit area of metal that is approximately equal to 1200 $mg/m^2$ is particularly preferred, in terms both of decorative effect and of mechanical and chemical resistance. The value of 1200 $mg/m^2$ is particularly optimal for a method serving to cover the inside surface 2 with a silver lining 8.

Advantageously, the metal-plating sub-step includes a final operation of emptying the cavity 3, which step consists in removing the solution containing the metal ions and the reducing agent from the bottle. The solution recovered in this way may optionally be re-used for metal-plating of another inside surface 2 of another bottle.

Preferably, the emptying operation in question is performed only once the solution contained in the cavity 3 (i.e. the mixture of the solutions containing the silver ions and a reducing agent) presents an appearance that is clear and translucent, signaling completion of the chemical reaction and thus of the covering process. Advantageously, the metal-plated inside surface 2 is then washed to remove reducing agent residues.

Advantageously, the method of the invention finally includes a baking step, subsequent to the metal-plating sub-step, in which baking step the metal-plated inside surface 2 is baked so as to dry and to harden the metal film present on the inside surface 2 as a result of implementation of the metal-plating sub-step, said metal film constituting the lining 8.

For example, for a method serving to cover the inside surface 2 with a layer of silver, the bottle 4 with its metal-plated inside surface 2 is baked at a temperature lying substantially in the range 50° C. to 300° C., and preferably about 180° C., for about 30 minutes, thereby making it possible to obtain a dry and hard silver film on the inside surface 2. The resulting silver lining 8 is attached extremely robustly to the inside surface 2 of the bottle, and satisfies the "adhesive tape test" consisting in applying a piece of adhesive tape to the lining 8 covering the inside surface 2, and then in removing the adhesive tape without the silver lining 8 being torn off significantly.

The resulting lining also withstands the "pencil tip test", i.e. it is not significantly scratched when the lead of a pencil of hardness 5H is scraped over it. Finally, it has been observed that a silver lining 8 obtained as explained above, fully withstands being put into prolonged contact with an alcoholic liquid, and in particular with a perfume. In particular, a silver lining deposited on the inside surface 2 of a glass bottle, using the method of the invention, is entirely stable when it is immersed in an alcoholic liquor for at least six months at ambient temperature, and for at least three months at 45° C. Additional steps may optionally be implemented after the baking step. Thus, it is possible to cover the metal lining 8 with a film of varnish for decorative and/or protective purposes.

It is also possible, once the lining 8 has been formed, to draw a decorative motif on said lining by removing the metal by means of a laser beam. In which case, the laser beam advantageously has its source outside the hollow body 1 and passes through the wall 1A thereof to reach the lining 8 from outside the hollow body 1 so as to modify said lining 8, and preferably to remove it, at least in part.

It is thus possible to remove the lining 8, at least in part, in order to create an esthetically pleasing decorative motif on the basis of the differences between the inside surface 2 that is covered with the lining 8, and the inside surface that is not covered with said lining. In order to achieve such targeted and controlled removal of said lining 8, it is possible, for example, to use a fiber laser, e.g. a laser of the Nd-Yag type, placed outside the hollow body 1 and emitting a laser beam suitable for passing through the wall 1A.

Other optional additional steps may also be implemented before the step of covering with the lining 8. For example, the method may advantageously include, at the beginning thereof, a prior operation of coloring the inside surface 2, by covering said surface with a colored layer, by any means known in the field, with a view to obtaining a colored inside surface 2.

The step of covering with the lining 8 is then implemented on said colored inside surface 2, thereby resulting in an inside surface 2 covered with a stack of two successive layers, namely a colored layer and a lining 8 of composition that is mostly metal. Such interposition of a colored layer between the inside surface 2 and the lining 8 makes it possible to obtain an esthetic result that is particularly original and attractive.

In addition, the method of the invention may advantageously include a sub-step of protecting said lining 8 with a protective layer (not shown) that comes into direct contact with the liquid or semi-liquid substance contained in said hollow body 1. The protective layer firstly protects said lining 8 from any incompatibility with said liquid or semi-liquid substance, and secondly protects said liquid or semi-liquid substance from any risk of its properties being degraded due to it being in contact with said lining 8.

For example, the protective layer is made up of a vitreous layer obtained by a sol-gel process, of a varnish, of a protective lacquer, of metal oxides, or of a plastics material obtained by plastic coating.

It is also particularly advantageous to wipe the hollow body 1 just before the baking step and after the metal-plating sub-step so as to remove any dirt, droplets, or traces present on the hollow body 1. After the baking step, any such defects are transformed into irremediable esthetic defects and inclusions that it is impossible to correct.

The method is described above essentially with reference to a preferred variant serving to cover the inside surface 2 with silver. However, the method may be implemented with other metals, such as gold, copper, nickel, zinc, or platinum, for example, in particular by adapting the type and the composition of the activation agent, of the grafting agent, and of the reducing agent.

Advantageously, the manufacturing method of the invention includes steps that are substantially identical regardless of the type of the metal lining.

In particular, the following first comparative table indicates, merely by way of illustration, examples of methods of the invention making it possible to obtain a metal lining 8 containing silver, copper (copper 1 or copper 2), gold, or nickel:

TABLE 1

| STEP | SILVER | COPPER I | COPPER II | GOLD | NICKEL |
|---|---|---|---|---|---|
| 1 | Rinse | Rinse | Rinse | Rinse | Rinse |
| 2 | Activate | Activate | Activate | Activate | Activate |
| 3 | Rinse | Rinse | Rinse | Rinse | Rinse |
| 4 | Graft | Graft | Graft | Graft | Graft |
| 5 | Rinse | Rinse | Rinse | Rinse | Rinse |
| 6 | Stove at 30° C. to 80° C. | Stove at ambient temperature | Stove at ambient temperature | Stove at ambient temperature | Stove at ambient temperature |
| 7 | Metal-plate: Introduce metal salt solution | Metal-plate: Introduce metal salt solution | Metal-plate: Introduce metal salt solution | Metal-plate: Introduce metal salt solution | Metal-plate: Introduce metal salt solution |
| 8 | Metal-plate: Introduce reducing solution | Metal-plate: Introduce reducing solution | Metal-plate: Introduce reducing solution | Metal-plate: Introduce reducing solution | Metal-plate: Introduce reducing solution |
| 9 | Agitate and partially fill bottle | Agitate and partially fill bottle | Agitate and fully fill bottle | Agitate and partially fill bottle | Agitate and fully fill bottle |
| 10 | Do nothing | Do nothing | Heat at 30° C. to 90° C. | Do nothing | Heat at 30° C. to 90° |
| 11 | Empty | Empty | Empty | Empty | Empty |
| 12 | Rinse | Rinse | Rinse | Rinse | Rinse |

TABLE 1-continued

| STEP | SILVER | COPPER I | COPPER II | GOLD | NICKEL |
|---|---|---|---|---|---|
| 13 | Bake at 50° C. to 180° C. | Bake under neutral atmosphere | Bake under neutral atmosphere | Bake at 50° C. to 180° C. | Bake at 50° C. to 180° C. |

This first table makes it possible to show that the steps of the method are substantially identical from one metal to the other.

The following second comparative table specifies the products and the reagents advantageously used during the steps described in the first table:

TABLE 2

| COMPONENTS | STEP | SILVER | COPPER I | COPPER II | GOLD | NICKEL |
|---|---|---|---|---|---|---|
| Metal salt | 7 | $Ag^+$ | $Cu^{2+}$ or $Cu^+$ | $Cu^{2+}$ or $Cu^+$ | $Au^+$ or $Au^{3+}$ | $Ni^{2+}$ |
| Complexing Agent | 7 | EDTA and other amine complexing agents, Rochelle salt, gluconate, organic acids, ammonia solution | | | | |
| Reducing Agent | 8 | Formaldehyde, gluconate, hydrazine, hydroxylamine, dimethylamine borane, borohydride, glyoxylic acid, hypophosphorous acid or salts thereof | | | | |

Preferably, the metal salt is mixed with a complexing agent in solution in order to facilitate the subsequent reducing reaction. The complexing and reducing agents indicated in the second table are given merely by way of indication, and it is also quite possible to deposit the metal with a plurality of complexing agent and reducing agent pairs. Other reducing agents also exist that are particularly effective and that can lead to reduction of the metal salts. Similarly, there are a vast range of complexing agents that can be used with the metal salt solution for the reducing reaction.

Depending on the chosen reducing agent, the pH is adjusted so that it lies within the operating range of the reducing agent.

These two tables thus give a few implementations of the method of the invention, which method may also include other optional steps, such as those described above (protective layer, cutting into the lining, etc.).

The invention also relates, per se, to a hollow body 1 that is suitable for being obtained by using the method of the invention as described above, and that is preferably obtained directly by the method in question.

As explained above, the hollow body 1 is provided with a glass inside surface 2 defining a cavity 3, at least a fraction of which surface is covered with a lining 8 of composition that is mostly metal.

Preferably, the lining 8 is mostly made of a metal selected from the following group: silver, gold, copper, nickel, zinc, and platinum. Metal-plating of the inside surface of the hollow body 1 makes it possible to obtain an excellent decorative effect, as explained above with reference to the method. In particular the lining 8 is advantageously visible by transparency through the wall 1A defining the cavity 3. The inside face of said wall 1A corresponds to the inside surface 2 on which the lining 8 is deposited. Said wall 1A also has an opposite outside face 11 on which it is possible to place marking 12, by any known means, and preferably to place marking 12 for decorative purposes. The marking 12 is thus separated from the metal lining 8 by the thickness $E_2$ of the wall 1A defining the cavity 3. The marking 12 is thus reflected in the lining 8, in particular when said lining is a silver lining that procures an excellent "mirror" effect, so that the user sees not only the marking 12 but also its distant reflection 13 and/or its shadow on the lining 8, which is particularly esthetically attractive. For example, the marking 12 can be achieved by screen-printing, the screen-printing operation being followed by baking that contributes to reinforcing the strength and stability of the lining 8.

Another possibility for reinforcing the mechanical strength and chemical stability of the lining 8 consists in implementing an optional step of hot-spraying (i.e. spraying on the heated hollow body 1) of a metal oxide (e.g. titanium oxide in solution) on the lining 8, e.g. after the baking step. Plasma deposition of the metal oxide is also possible. This operation for covering the lining 8 with a metal oxide makes it possible to improve the "liquor resistance" of the lining 8. Advantageously, the lining 8 covers the inside surface 2 in a mass per unit area substantially equal to or greater than 800 mg/m$^2$, and preferably substantially equal to or greater than 1000 mg/m$^2$, a value approximately equal to 1200 mg/m$^2$ being preferred for reasons of strength and of esthetically pleasing appearance, in particular when the lining is mostly made of silver.

Preferably, the inside surface 2 is substantially fully covered with the lining 8, as shown in FIG. 2, while the thickness $E_1$ of said lining 8 is advantageously substantially uniform. However, it is quite possible for only a fraction of the inside surface 2 to be covered with the lining 8, such selective covering being obtained, for example, by temporarily masking the fraction of the inside surface 2 that is not to be covered with the lining 8. It is thus possible for the non-covered zones of the inside surface 2 to form a decorative motif. Alternatively, it is also quite possible for a fraction of the lining 8 to be cut by means of a laser beam as mentioned above.

Advantageously, the hollow body 1 of the invention comprises a single piece of glass inside which the cavity 3 is formed. The hollow body 1 is also preferably designed to be taken hold of and handled by hand.

In a particularly preferred variant, and as explained above, the hollow body 1 of the invention preferably constitutes a container 4 designed to contain a liquid or semi-liquid substance in its cavity 3, and in particular to contain an alcoholic liquid such as a body perfume, said container being designed to be closed by means of a closure member 5. More precisely, the cavity 3 advantageously forms a throat 6 defining an opening 7 making it possible to put the cavity 3 into communication with the outside, said opening 7 being designed to co-operate with the closure member 5, preferably constituted by a stopper 5A for closing said container. Advantageously, the hollow body 1 thus constitutes a bottle 4 that has a throat 6 forming a neck at its opening 7, and that serves to store and to dispense a liquid body perfume, being understood that the hollow body 1 is preferably designed so that the lining 8 is in contact, and preferably in direct contact, with said liquid or semi-liquid substance. In other words, the hollow body 1 is designed so that the lining 8 itself directly defines the cavity 3, i.e. it forms the most superficial layer of the inside surface 2, which layer is designed to be in contact with the substance contained in said cavity 3. However, it is quite possible, in a variant implementation that is mentioned above with reference to the method, for the lining 8 itself to be covered with a protective layer, e.g. based on metal oxides (e.g. titanium oxide).

SUSCEPTIBILITY OF INDUSTRIAL APPLICATION

The invention is susceptible of industrial application in designing and manufacturing hollow bodies provided with glass inside surfaces and usable in various industries, in particular in the packaging industry or in the construction industry.

The invention claimed is:

1. A method of manufacturing a hollow body (1) comprising a glass inside surface (2) defining a cavity (3), said method comprising:

covering at least a fraction of said inside surface (2) with a lining (8) of a metallic composition, said covering further comprising activating and grafting said inside surface (2) respectively with an activation agent and with a grafting agent, said hollow body (1) comprising a single piece of glass defining said cavity (3), said body (1) constituting a container (4) that contains a body perfume and/or alcoholic liquid in said cavity (3), said container (4) closed by means of a closure member (5).

2. A method according to claim 1 in which the activation agent is a tin Chloride solution.

3. A method according to claim 1 in which said lining (8) is mostly made of a metal selected from the group consisting of: silver, gold, copper, nickel, platinum, and zinc.

4. A method according to claim 1, in which said lining (8) forms the most superficial layer of the inside surface (2) that is in contact with the body perfume and/or alcoholic fluid contained in said cavity (3).

5. A method according to claim 1, in which the activation is performed by putting the inside surface (2) into contact with the activation agent, so as to obtain an activated inside surface (2).

6. A method according to claim 5, in which the grafting makes it possible to graft the grafting agent chemically onto said activated inside surface (2) by a chemical reaction, which leads to chemical bonds being formed between the grafting agent and the activation agent.

7. A method according to claim 5 in which said putting the inside surface (2) into contact with the activation agent comprises spraying said activation agent in solution onto the inside surface (2).

8. A method according to claim 5, in which said grafting comprises putting the activated inside surface (2) into contact with a grafting solution, in order to obtain a grafted inside surface (2).

9. A method according to claim 8, in which said grafting solution is constituted by a palladium chloride solution.

10. A method according to claim 8 in which putting said activated inside surface into contact with a grafting solution is performed by filling said cavity with said grafting solution, said filling itself being performed by means of a filling machine having a central nozzle (9) via which said grafting solution flows into the cavity, and a peripheral suction nozzle (10) concentric to the central nozzle (9) and serving to suck up any overflow of grafting solution.

11. A method according to claim 8 in which said putting the activated inside surface (2) into contact with the grafting agent comprises spraying the grafting solution onto the activated inside surface (2).

12. A method according to claim 8 in which said covering step comprises a silver-plating sub-step making it possible to obtain a silver-plated inside surface (2), said silver-plating sub-step itself comprising:

putting the grafted inside surface (2) into contact with a solution containing silver ions; and introducing a reducing agent into said solution containing silver ions, while said solution is in contact with the grafted inside surface (2), so as to transform the silver ions into silver that attaches to the grafting agent.

13. A method according to claim 8 in which said covering step comprises a metal-plating sub-step making it possible to obtain a metal-plated inside surface (2), said metal-plating sub-step itself comprising:

putting the grafted inside surface (2) into contact with a solution containing metal ions; and introducing a reducing agent into said solution containing metal ions, while said solution is in contact with the grafted inside surface (2), so as to transform the metal ions into metal that attaches to the grafting agent.

14. A method according to claim 13, in which the metal-plating sub-step also comprises an operation of mechanically agitating the grafted inside surface (2), while said surface is in contact with said solution contacting both the metal ions and the reducing agent, so as to obtain a metal deposit that is substantially uniform over the grafted inside surface (2).

15. A method according to claim 13 including a baking step, subsequent to the metal-plating sub-step, in which baking step the metal-plated inside surface (2) is baked so as to dry and to harden the metal film present on the inside surface due to implementation of the metal-plating sub-step.

* * * * *